United States Patent [19]

Sloan

[11] 3,957,403

[45] May 18, 1976

[54] DEWATERING PUMP ASSEMBLY

[76] Inventor: Albert H. Sloan, 4201 Kean Road, Fort Lauderdale, Fla. 33314

[22] Filed: Dec. 27, 1974

[21] Appl. No.: 536,831

Related U.S. Application Data

[62] Division of Ser. No. 415,997, Nov. 15, 1973, Pat. No. 3,910,728.

[52] U.S. Cl. ..... 417/390; 415/170 A; 415/197

[51] Int. Cl.² ..... F04B 9/08; F01D 1/02

[58] Field of Search ..... 417/375, 390; 415/172, 415/174, 170 A, 197

[56] References Cited

UNITED STATES PATENTS

| | | | |
|---|---|---|---|
| 640,345 | 1/1900 | Wilberforce | 415/174 |
| 2,346,372 | 4/1944 | Foottit et al. | 417/375 |
| 2,668,068 | 2/1954 | Bredemeier | 415/170 A |
| 3,136,258 | 6/1964 | Bood | 417/367 |
| 3,275,330 | 9/1966 | Rein et al. | 415/170 A |
| 3,398,694 | 8/1968 | Lerch | 417/375 |
| 3,574,487 | 4/1971 | Mohn | 417/409 |

FOREIGN PATENTS OR APPLICATIONS

| | | | |
|---|---|---|---|
| 411,839 | 7/1945 | Italy | 415/197 |

*Primary Examiner*—William L. Freeh
*Assistant Examiner*—G. P. LaPonte
*Attorney, Agent, or Firm*—James E. Nilles

[57] ABSTRACT

A dewatering pump assembly for pumping water from excavations or other holes in the ground and upwardly to a more or less remote discharge area. The pump assembly includes a housing in which the impeller, fluid motor, and the connecting drive shaft all are located and the drive shaft and its bearings sealed in a bath of pressurized oil to prevent water from leaking into the housing.

4 Claims, 6 Drawing Figures

DEWATERING PUMP ASSEMBLY

RELATED COPENDING APPLICATION

This is a divisional application of U.S. Ser. No. 415,997, filed Nov. 15, 1973, entitled "Dewatering Pumping Apparatus", which issued on Oct. 7, 1975 as U.S. Pat. No. 3,910,728.

BACKGROUND OF THE INVENTION

This invention pertains to a dewatering pump assembly, for pumping water out of excavations, other holes in the ground, or emptying large tanks or the like.

In pump assemblies of the general type to which the present invention pertains, several shortcomings have existed, one of which is being unable to prevent water from leaking into and around the coupling between the impeller of the pump assembly and fluid motor to which the impeller is connected.

Other shortcomings include the excessive time and labor necessary to dismantle the water pump assembly including the impeller, in order to inspect, repair or replace various parts as required.

SUMMARY OF THE INVENTION

The present invention provides a dewatering pump assembly including a housing in which a fluid motor is located to drive a pump impeller in the housing. Bearing means are provided in a bearing housing between the motor and the impeller and which housing can be pressurized by fluid pressure from the motor; the housing being sealed in such a manner that water is prevented from entering the bearing housing and particularly the bearings due to pressurization of the pressure fluid in the bearing housing. The motor is thus able to efficiently drive the impeller with no particular drag being imposed on it. Another aspect of the pump assembly relates to a removable liner within the housing and which is located around the periphery of the impeller, thereby enabling the removable liner to be quickly inspected or replaced due to the considerable wear to which that internal area of the pump assembly is subjected.

These and other objects and advantages of the present invention will appear hereinafter as this disclosure progresses, reference being had to the accompanying drawings.

DESCRIPTION OF A PREFERRED EMBODIMENT

General Organization

Figure 1:
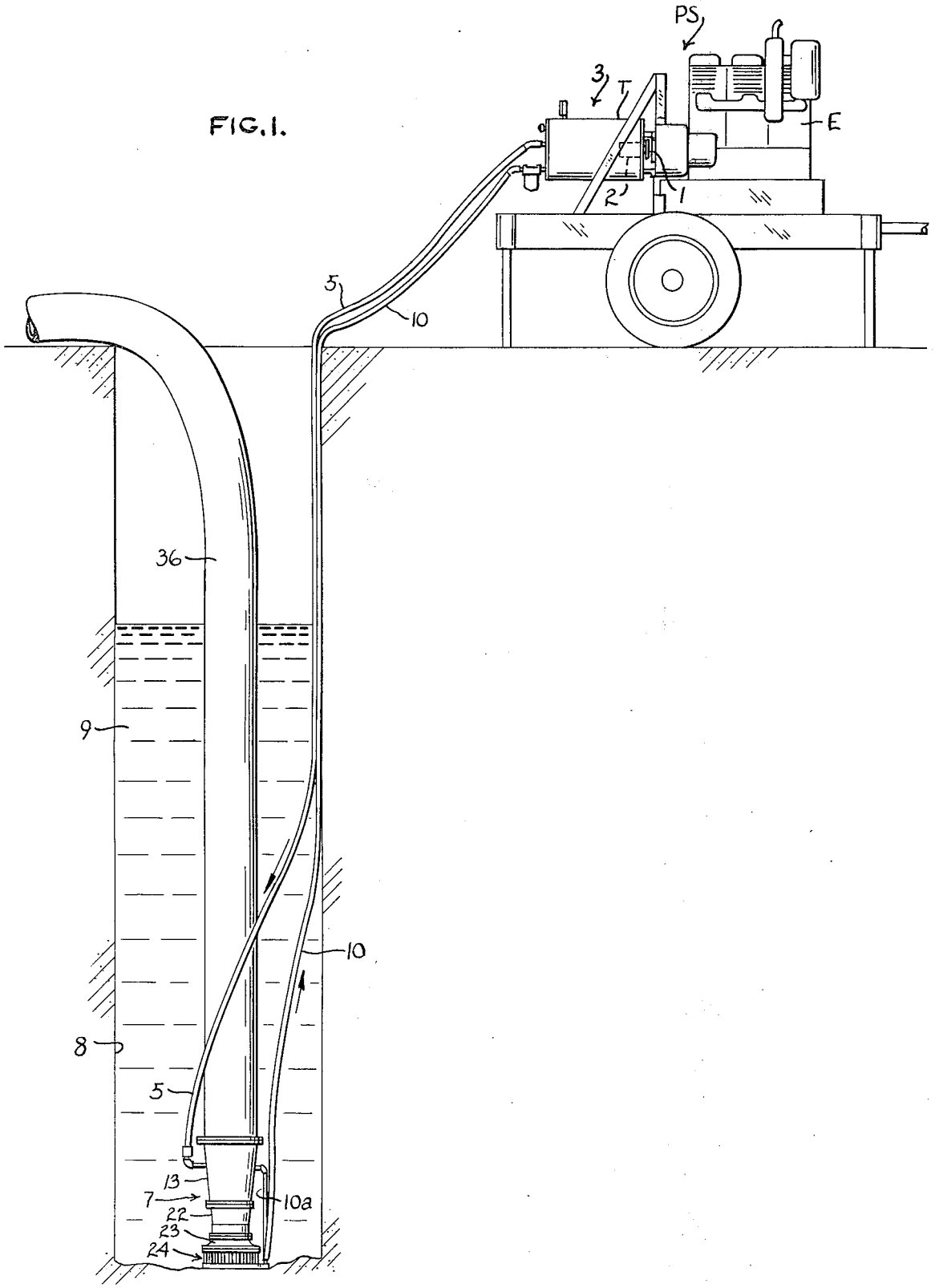
FIG. 1 is an elevational view of a dewatering pumping apparatus made in accordance with the present invention and certain parts being shown as broken away or removed for the sake of clarity.

The general arrangement of overall pumping apparatus with which the present invention is used includes a mobile power source PS comprising, for example, an internal combustion engine E, having a conventional flywheel 1 to which a positive displacement, pressure fluid pump 2 is attached for being driven by the engine. The power source PS may be one of a variety of different types or sizes, depending on the power requirements, sizes or types of the pump assembly required for the conditions encountered. The power source may be a four or six cylinder, internal combustion engine for example, is highly mobile, and is located up at normal ground level.

The fluid pump 2 is located together with other elements in a tank assembly 3, mounted on the mobile power source, and which tank assembly contains various other components not pertinent to this invention. The fluid pump 2 directs pressurized fluid through a long flexible conduit 5 to a water pump assembly 7 which is located in the bottom of an excavation 8 and more precisely, directly in the water to be pumped from the excavation. Another conduit 10 returns the pressure fluid back up to the tank assembly 3 on the power source PS.

Water Pump Assembly

The water pump assembly includes a positive displacement pressurized fluid motor 12 which is located in a tubular discharge housing 13 of the pump assembly 7. A heat exchanger HE is secured on the lower end of the assembly. The pressure fluid conduit 5 directs pressure fluid from the fluid pump 2 to the fluid motor 12. After passing through the motor, the fluid is directed via conduit **10*a*** to the heat exchanger.

Figure 2:
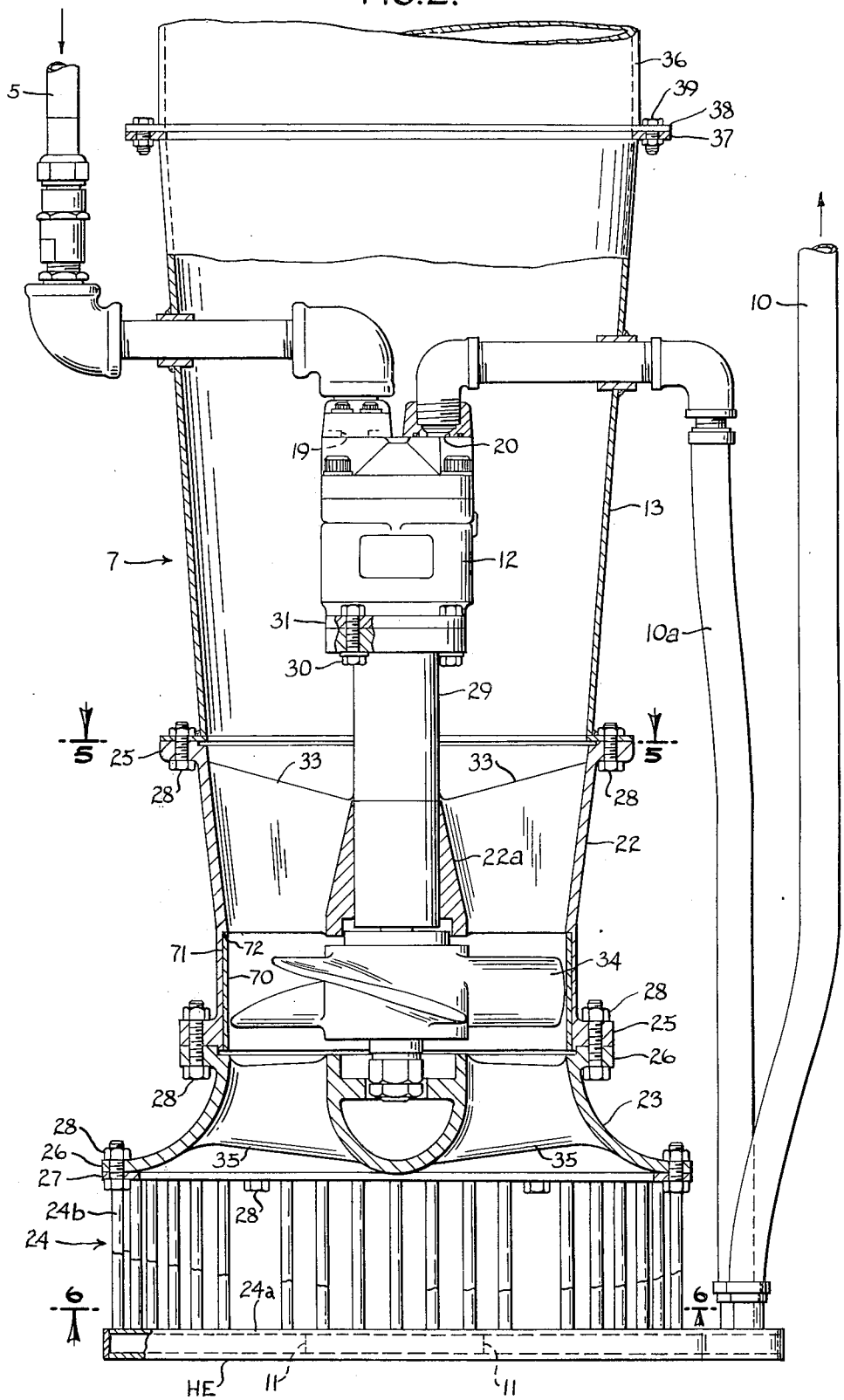
FIG. 2 is an enlarged view, partially in section, and with certain parts broken away of a portion of the apparatus shown in FIG. 1, namely the pump assembly.

The heat exchanger, shown clearly in FIGS. **2, 9, 9*a* and 10 is fabricated from steel plates and is generally hollow so as to define a chamber 9 (FIG. 2) and in which baffle plates 11 are located so that the pressure fluid is directed into the chamber 9 via conduit 10A and is caused to circulate thoroughly in the chamber to effect cooling. The heat exchanger is located in the coolest part of the water being pumped and is effective in cooling the pressure fluid after it has passed through the fluid motor 12. The fluid then is returned via conduit 10** to the fluid pump.

In addition to the discharge housing 13, the pump assembly 7 also includes a bearing and stator housing 22 which houses stators 33, a concentric pump shaft and bearing housing 29, and an impeller 34, all to be referred to. The assembly also includes a stator housing 23 containing stators 35 and located generally near the intake of the pump assembly 7, and an endmost water intake section 24. The intake section shown has an end closure plate 24a (FIG. 2) and an open grill **24*b* around its periphery for the entry of material such as water, sand, sludge, etc. to be pumped. Annular flanges 25, 26 and 27 are provided around the peripheries of the housings 22, 23 and section 24, respectively, and through which flanges the bolt means 28** extend to detachably hold the housings and intake section together. As will later appear, this flange construction and bolt means between the housings and intake section, permits various housings to be assembled together, including different type intake sections to be utilized depending on the material to be pumped, that is to say, depending on whether "trash", such as water and sand and/or rocks, or other material is to be pumped.

As previously mentioned, the pump assembly 7 includes a pump shaft and bearing housing 29 mounted concentrically within the bearing and stator housing 22. This housing 29 extends through a central stator hub 22a (FIGS. 2 and 3) of the stators 33 and is connected by bolt means 30 to the flange 31 of the motor 12. Within the bearing housing 29 is journalled a pump shaft 32 connected at one end to and driven by the fluid motor 12, as will appear, and a pump impeller 34 is fixed on the threaded end of the pump shaft 32 by shoulder 32*a*, key 32*b* and by nut means 32*c* and is rotationally driven by the fluid motor 12.

A plurality of circumferentially spaced stators 33 are located within the bearing and stator housing 22 and a plurality of circumferentially spaced stators 35 are fixed within the stator housing 23. Stators 33 and 35 act to straighten out the flow of water through the pump assembly.

The water pump assembly 7 is located down in the bottom of the excavation, vessel or other area to be pumped out, and the pressure fluid pump 2 is connected to the fluid motor 12 of the pump assembly 7 by the long flexible hoses such as conduits 5 and 10. The water is pumped through the discharge housing 13 of the pump assembly and into a long flexible discharge pipe 36. The pipe 36 is quickly attachable to the pump assembly 7 by means of the flanges 37 and 38 (FIG. 2) of the discharge housing 13 and discharge pipe 36, respectively, which flanges are held together by the bolt means 39. The discharge pipe 36 extends upwardly out of the area to be dewatered and to a remote location if necessary, for discharge of the water, trash, sludge, rocks, or the like.

The fluid motor 12, which is driven by the pressure fluid pump 2, is a positive displacement, gear type motor, for example, in which conventional intermeshing gears (not shown) are rotatably driven by pressure fluid and act to drive an output 40 (FIG. 3) of the motor. By removing the fluid seal (not shown) from around shaft 40 in the motor 12, pressure fluid from the motor 12 can pass outwardly around its shaft 40 and thereby flood and pressurize the interior of housing 29.

Figures 3, 4:
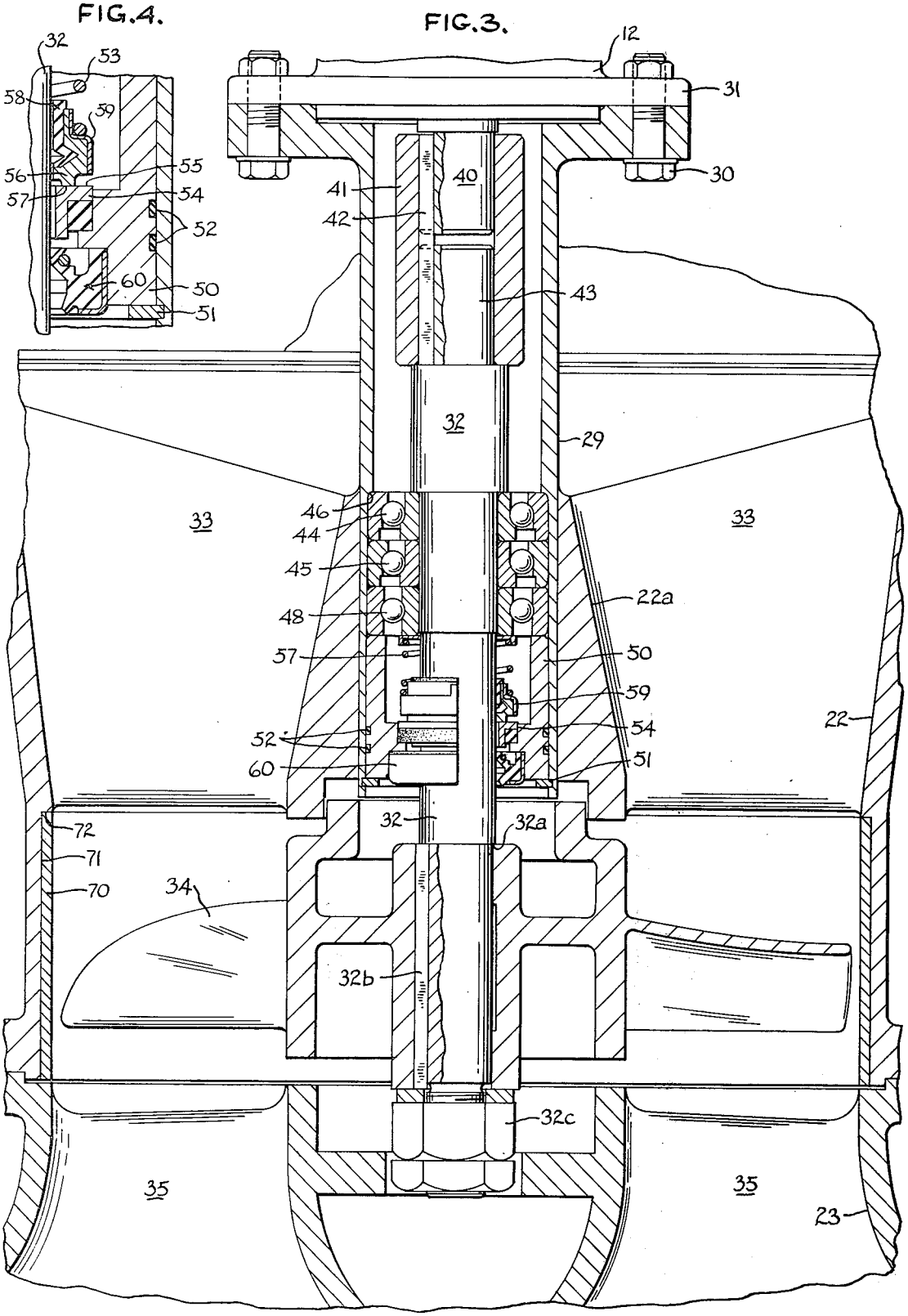
FIG. 3 is a still further enlarged and fragmentary view showing a portion of the pumping assembly shown in FIG. 2.
FIG. 4 is a fragmentary and enlarged view of the shaft sealing arrangement shown in FIG. 3.
Figure 5:
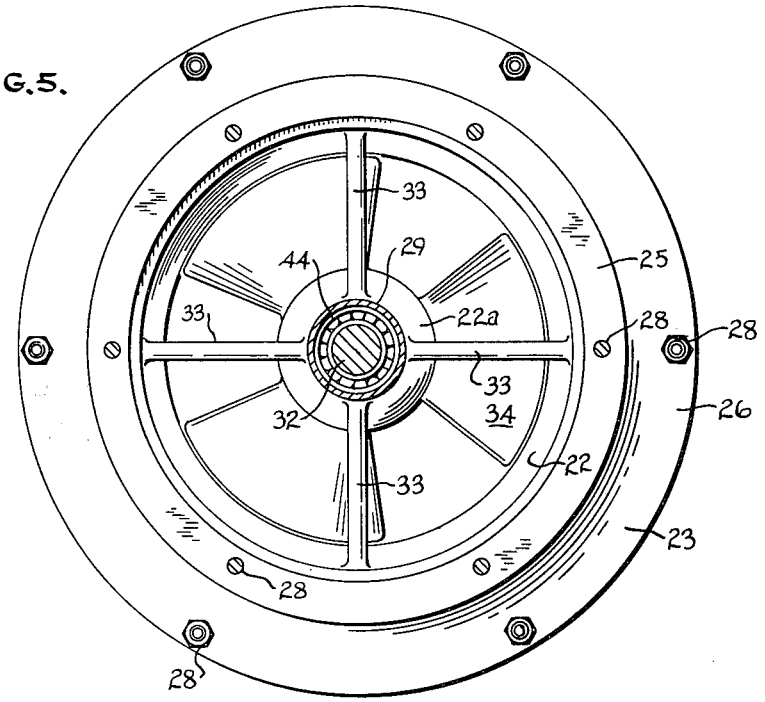
FIG. 5 is a sectional view taken generally along the line 5—5 in FIG. 2.
Figure 6:
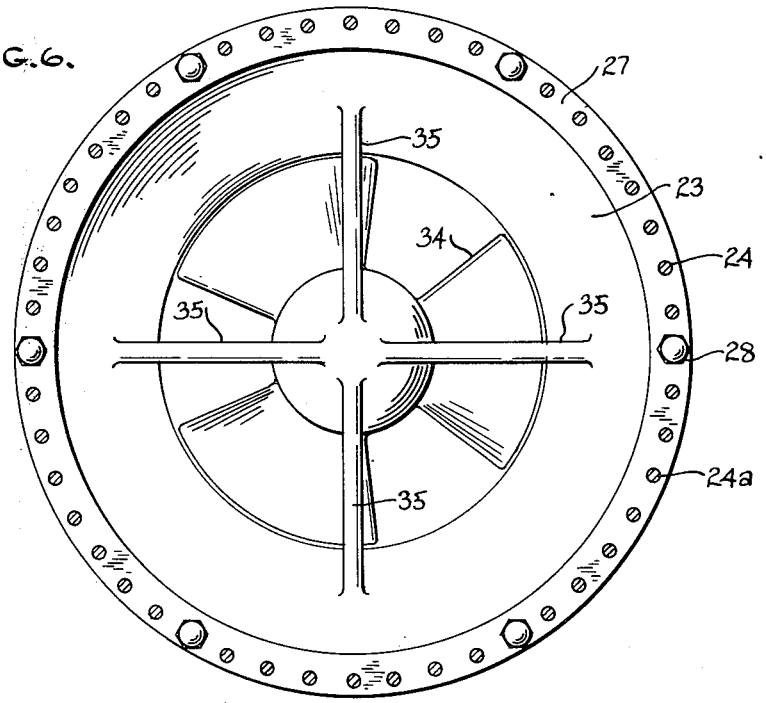
FIG. 6 is a sectional view taken generally along the line 6—6 in FIG. 2.

The motor shaft 40 is connected to the pump shaft 32 as shown in FIG. 3 by means of a collar 41 and key 42. The end 43 of the pump shaft is piloted on and is supported by the motor shaft 40, thereby utilizing the internal bearing (not shown) of the fluid motor 12 for supporting one end of the pump shaft 32.

The pump shaft 32 is also supported within the fluid pressurized bearing housing 29 by means of a pair of anti-friction thrust bearings 44 and 45 (FIG. 3). The outer race of thrust bearing assembly 44 is held from axial movement in one direction by a shoulder 46 formed in the inner surface of the bearing housing 29. The bearing assemblies 44 and 45 act to absorb the axial thrust which is imposed on the shaft when the bronze impeller 34 is pumping water. A third anti-friction bearing assembly 48 is located adjacent and abuts tightly against bearing assembly 45 and is of the radial bearing type, that is to say, its primary purpose is to absorb the radial thrust of the pump shaft 32. The three bearing assemblies 44, 45 and 48 are held captive against shoulder 46 by a tubular seal holder 50 snugly located within the bearing housing 29 and a snap ring 51, at the lower end of the seal holder, acts to hold the seal holder axially in place.

Suitable flexible O-ring seals 52 are located in the seal holder periphery and seal against the inner surface of the housing 29.

The seal holder 50 also acts to support a mechanical seal which includes ring 54 (FIGS. 3 and 4) having a ground flat radial surface 55 against which a nose piece 56 is urged by the spring 53. The nose piece 56 also has a ground flat surface 57 which bears against the surface 55 of the seal ring 54, thereby providing a mechanical, rotary sliding seal between the seal holder 50 and shaft 32. The nose piece 56 is preferably formed of tungsten carbide and is cemented to a flexible boot 58. The boot is urged against the shaft 32 by a metal ring 59.

A flexible seal 60 is press fit in the seal holder 50 and rubber lips engage shaft 32 to primarily prevent the entry of dirt.

The seal holder 50 and its mechanical seal and dirt seal can be inserted or removed as a unit for inspection, replacement, or repair.

Thus three different types of seals are provided between the shaft 32 and the bearing housing 29, namely the anti-friction bearing seals 44, 45 and 48, the mechanical fluid seal 55, 56, and the third flexible seal 60.

The arrangement is such that the interior of the bearing housing 29 is flooded with pressurized oil from the fluid motor 12, and this pressure is maintained in the bearing areas and within the bearing housing and prevents water from entering these areas. In other words, water is prevented from entering the bearings and the bearing housing, by pressurizing the interior of the housing 29 with oil at a greater pressure than that of the water pressure of the water being pumped. Furthermore, and importantly, with this pressurized oil feature, the pump assembly 7 can run dry, that is to say, it can run regardless of whether or not water is in the hole being excavated.

Thus, a water pump is provided which is sealed against the outside water by purposely providing pressurized fluid, such as oil from the pressurized motor 12, in the interior of the bearing housing 29. The pressure of the oil within housing 29 need only be slightly greater than the pressure of the water, and slight leakage of oil out of the housing is permissible.

Generally, with the present pump apparatus, water pump assemblies 7 of different styles and of different sizes may be interchangably used as conditions require.

The pump shown in FIGS. 1–6, has an impeller 34 which is of the axial flow type and known as a dewatering pump. This particular pump assembly finds particular utility when pumping principally water with no sand and in pumping under low pressure head conditions, say a lift of 15 to 17 feet, and for high volume discharge.

The present invention provides a pump assembly that is easily taken apart for service, repair or replacement of parts and which can be assembled and put into operation. Furthermore, these pumps can be readily interchanged with one another to provide for any type of pump for any job condition.

In pump assemblies of this character, one principal area of wear in the pump is in the interior of the pump housing adjacent the tips of the impeller and this area is subjected to particularly abrasive action, galling or other wear. The pump assemblies of the present invention are provided with a cylindrical steel sleeve or liner 70 (FIGS. 2 and 3) which can be axially press fit into the stator housing 22. A counterbore 71 may be formed in the housing, forming a shoulder 72 in the housing, and one end of the liner abuts against the shoulder 72. This cylinder wear sleeve or liner 70 is then held captive in the counterbore and in precise relationship with the tips of the impeller, when the bearing and stator housing 23 is bolted by its flange 26, to the lower flange 25 of the stator housing 22. To remove the liner for inspection or repair, it is only necessary to remove the stator housing 23 to gain access to the liner 70.

The bearing assembly for the water pump is connected between the fluid pressure motor and the impeller, and provides a pressurized area within the sealing arrangement of the anti-friction bearing assemblies, and which pressurized area keeps the water from entering the bearing area. The bearing assemblies provide good radial and axial thrust, support, and also provides a rotary sliding seal arrangement between the pressurized area of the bearings and the water being pumped.

The replaceable sleeve liner located in a precise relationship to the impeller is easily removed for inspection, replacement or repair.

With the pump assembly as shown, various intake sections can be readily interchanged depending on the material being pumped.

I claim:

1. A dewatering pump assembly comprising a generally tubular housing, said housing having stator means therein, a bearing housing in said tubular housing and mounted on said stator means and concentrically with said tubular housing, a fluid motor connected to one end of said bearing housing, a pump shaft extending through said bearing housing and connected at one end to said fluid motor, a water pumping impeller in said generally tubular housing and secured to the other end of said pump shaft for being driven by said fluid motor, a tubular seal holder snugly located within said bearing housing, anti-friction bearing means located within said bearing housing for rotationally supporting said pump shaft therein, said seal holder abutting against said bearing means, and a mechanical rotary sliding seal in and supported by said seal holder and providing a fluid seal between the interior of said bearing housing and said shaft, whereby water is prevented from entering the interior of said bearing housing, said interior of said bearing housing being pressurized with fluid pressure from said fluid motor to thereby prevent leakage of water past said bearing means.

2. The pump assembly as set forth in claim 1 including a stator housing secured to said generally tubular housing at the intake side of said impeller which is opposite to said bearing housing, and a water intake section connected to said stator housing and through which water is admitted to said generally tubular housing for being pumped by said impeller and through said tubular housing.

3. A dewatering pump assembly comprising a generally tubular housing, a bearing housing mounted in said tubular housing and concentrically with said tubular housing, a fluid motor connected to one end of said bearing housing, a pump shaft extending through said bearing housing and connected at one end to said fluid motor, a water pumping impeller in said generally tubular housing and secured to the other end of said pump shaft for being driven by said fluid motor, a tubular seal holder snugly located within said bearing housing, anti-friction bearing means located within said bearing housing for rotationally supporting said pump shaft therein, said seal holder in said bearing housing being located between said anti-friction bearing means and said impeller, and a mechanical seal in said seal holder and providing a fluid seal between the interior of said bearing housing and said shaft to prevent water from entering the interior of said bearing housing, said mechanical seal being of the rotary sliding seal type, said interior of said bearing housing being pressurized with fluid pressure from said fluid motor to thereby also prevent leakage of water into said bearing housing.

4. A dewatering pump assembly comprising a generally tubular housing, said housing having stator means therein, a bearing housing in said tubular housing and mounted on said stator means and concentrically with said tubular housing, a fluid motor connected to one end of said bearing housing, a pump shaft extending through said bearing housing and connected at one end to said fluid motor, a water pumping impeller in said generally tubular housing and secured to the other end of said pump shaft for being driven by said fluid motor, a generally tubular seal holder fixed in said bearing housing, a replaceable cylindrical sleeve liner mounted in said tubular housing and located around said impeller, and means for securely but replaceably holding said liner in said housing, anti-friction bearing means located within said bearing housing for rotationally supporting said pump shaft therein, and a mechanical seal of the rotary sliding seal type in said seal holder and providing a fluid seal between the interior of said bearing housing and said shaft, whereby water is prevented from entering the interior of said bearing housing, said interior of said bearing housing being pressurized with fluid pressure from said fluid motor to thereby prevent leakage of water past said bearing means.

* * * * *